United States Patent [19]

Dellinger

[11] Patent Number: 4,646,855

[45] Date of Patent: Mar. 3, 1987

[54] METHOD FOR RAISING AND LOWERING A DRILL STRING IN A WELLBORE DURING DRILLING OPERATIONS

[75] Inventor: Thomas B. Dellinger, Duncanville, Tex.

[73] Assignee: Mobil Oil Corporation, New York, N.Y.

[21] Appl. No.: 668,921

[22] Filed: Nov. 6, 1984

[51] Int. Cl.[4] ..... E21B 7/04

[52] U.S. Cl. ..... 175/61; 175/65; 175/73

[58] Field of Search ..... 175/61, 62, 65, 73, 175/75, 91, 101, 107, 38, 45

[56] References Cited

U.S. PATENT DOCUMENTS

| | | | |
|---|---|---|---|
| Re. 29,526 | 1/1978 | Jeter | 175/61 X |
| 3,260,318 | 6/1966 | Neilson et al. | 175/75 |
| 3,667,556 | 6/1972 | Henderson | 175/73 |
| 3,841,420 | 10/1974 | Russell | 175/45 |
| 4,143,722 | 3/1979 | Driver | 175/61 X |
| 4,485,879 | 12/1984 | Kamp et al. | 175/107 |
| 4,492,276 | 1/1985 | Kamp | 175/61 |

*Primary Examiner*—Stephen J. Novosad
*Assistant Examiner*—David J. Bagnell
*Attorney, Agent, or Firm*—Alexander J. McKillop; Michael G. Gilman; George W. Hager, Jr.

[57] ABSTRACT

A rotary well drilling system employs a drill pipe with a drill bit affixed at its lower end for the drilling of a wellbore. Drilling fluid is circulated through the drill pipe to remove drill cuttings. When raising and lowering the drill pipe in the wellbore, the drill pipe is continuously rotated along with continued drilling fluid circulation to prevent sticking of the drill pipe. The drill bit is rotated by a mud motor in the opposite direction from that of the drill pipe and at the same speed so that the drill bit remains rotationally stationary with respect to the wellbore and does not side-track as it is dragged along the lower side of the wellbore wall when being raised or lowered in an inclined wellbore.

1 Claim, 1 Drawing Figure

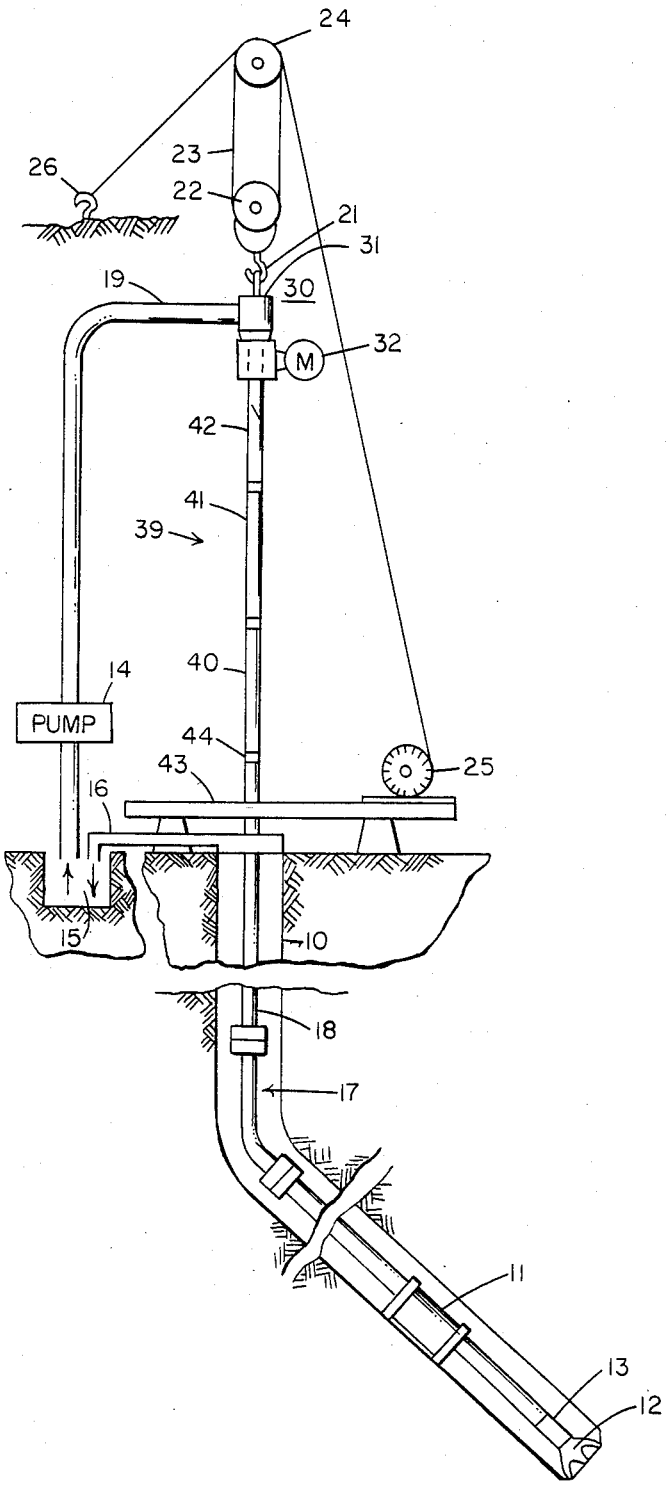
24
23
26
22
21
31
19
30
32
M
42
41
39
40
14
PUMP
44
43
25
16
15
10
18
17
11
13
12

METHOD FOR RAISING AND LOWERING A DRILL STRING IN A WELLBORE DURING DRILLING OPERATIONS

BACKGROUND OF THE INVENTION

Drilling of oil wells has progressed from crude drilling rigs, to cable tool rigs, to the modern rotary drilling rigs. In rotary conventional drilling, a power rotating means delivers torque to a drill string comprising sections of drill pipe which turns a bit drilling a borehole into the subsurface formations. The drill string is raised and lowered in the borehole from support means affixed to a conventional drilling rig. Suspended over pulleys positioned at the upper end or top of the rig are a plurality of cables which support a traveling block. Suspended from the traveling block is a swivel. The swivel is secured to a kelly which supports the drill string. The kelly is square or hexagonal in cross-section over a substantial portion of its length and fits in sliding relation through a rotary table in the rig floor. The rotary table, driven by a suitable prime mover, serves to turn the kelly, thereby rotating the drill string. Due to the sliding fit between the kelly and the rotary table, the kelly slides downwardly through the rotary table as drilling progresses. While the power for rotating the kelly, and thus the drill string, is applied to the rotary table, the entire weight of the kelly and drill string is supported by the swivel which also functions to conduct drilling fluid to the kelly and drill string. Drilling fluid, generally from a mud tank or mud pit, passes through a hose into the swivel, downward through the sections of drill pipe, and out through openings in the drill bit into the borehole. The drilling fluid then circulates upward from the drill bit, carrying formation cuttings through the annulus between the sections of drill pipe and the borehole wall to the surface of the earth where it returns to the mud tank or pit. When it is necessary to add another section of drill pipe during drilling to the wellbore or to remove a section of drill pipe when pulling out of the borehole (i.e., tripping), the traveling block, swivel, and kelly are lowered or raised as needed by manipulation of the cables. Such a conventional drilling system is illustrated in U.S. Pat. Nos. 3,235,014; 3,324,717; 3,417,830; and 4,114,435.

Recent developments in drilling technology have replaced the conventional kelly and rotary table drive system with a power swivel employing an electric drive system for directly rotating the drill string. The power swivel is suspended from the traveling block and is fully compatible with the derricks or masts of the conventional drilling rig as well as the hoisting and electrical power systems of such rigs. One of the several advantages of the power-swivel top drive drilling system over the kelly and rotary table drilling system is the ability to rotate the drill string and circulate the drilling fluid when raising or lowering (i.e., tripping) of the drill pipe in or out of the borehole. This ability to rotate and circulate at any time while tripping provides significant time savings and safety features, especially where the potential for preventing sticking of drill pipe in tight sections or high angle boreholes is greatly increased.

SUMMARY OF THE INVENTION

In accordance with the present invention, there is provided a method for raising or lowering a drill pipe in the wellbore of a well being drilled at an inclination such that the drill pipe and drill bit drag along the lower side of the wellbore wall when being raised or lowered in the wellbore. More particularly, the present invention prevents the side-tracking of the drill bit into such lower side of the wellbore wall as the drill pipe is being rotated and raised or lowered.

The drill pipe is rotated and drilling fluid is continuously circulated through the drill pipe and the annulus between the drill pipe and the wellbore during the raising or lowering of the drill pipe so as to prevent sticking of the drill pipe in tight sections of the wellbore. The drill bit is rotated in the opposite direction from the rotation of the drill pipe and at the same speed as that of the drill pipe so that the drill bit remains rotationally stationary with respect to the wellbore. Consequently, the rotating drill bit does not side-track as it is dragged along the wellbore during the raising or lowering of the drill pipe. The rotating of the drill bit is preferably carried out with a positive displacement downhole motor which is driven by means of power supplied by the circulating drilling fluid. The rotational speed of the drill bit is set at the same speed as that of the drill pipe by adjusting the flow rate of the circulating drilling fluid.

BRIEF DESCRIPTION OF THE DRAWING

The sole FIGURE illustrates a well drilling system for drilling a deviated well and in which the method of the present invention may be used.

DESCRIPTION OF THE PREFERRED EMBODIMENT

Referring now to the FIGURE, there is shown a deviated well 10 being drilled into the earth by rotary drilling and in which the method of the present invention may be utilized. A drill string 17 is suspended within the well 10, and includes a drill pipe 18, a plurality of drill collars 11 and a drill bit 12. A top drive drill system 30, including a swivel 31 and driving motor 32, rotates the drill string 17. Generally, the drill string 17 is held in tension and only the weight of the drill collars 11 or less is allowed on the drill bit 12. Hence, a major portion of the load is borne by the hook 21 attached to the traveling block 22. The traveling block is moved by multiple windings of cable 23 between it and a crown block 24. One end of the cable 23, the so-called "dead line," is held by a dead line anchor 26. The other end of the cable 23 is fastened to the drum 25 of the drawworks and is wound onto it by rotation of that drum. To achieve less or more weight on the drill bit 12, the traveling block 22 is raised or lowered to take more or less of the weight of the drill collars 11. Simultaneously with the rotation of the drill string 17, a drilling fluid from a mud tank or pit 15 is circulated by a drilling fluid pump 14 through the line 19 into the swivel 31 and hence, into the drill string 17. The drilling fluid flows down through the drill string 17 and out through openings in the drill bit 12 into the well 10. The drilling fluid then circulates upward from the drill bit 12, carrying formation cuttings through the annulus between the drill string 17 and the well 10 to the surface of the earth. A line 16 returns the drilling fluid from the well 10 to the pit 15.

When raising or lowering the drill string 17 in the wellbore, i.e., tripping, the top drive drill system 30 continues the rotation of the drill string which, along with continued circulation of drilling fluid, provides significant time savings and safety features, especially where the potential for preventing sticking of drill pipe in tight sections or high-angle boreholes is greatly increased. However, in deviated boreholes of high angles of inclination, the weight of the drill string rests almost entirely against the lower side of the wellbore wall. As the drill string is tripped in or out of the wellbore, while being continuously rotated, the drill bit drags along this lower side of the wellbore. Due to its being rotated, the drill bit tends to erode the lower side of the wellbore, especially if left at one spot or if working downward through a blocked borehole full of cuttings or cavings from the wellbore wall. This causes the drill bit to leave (i.e., side-track) the original wellbore. When this occurs at some point above the bottom of the wellbore, the distance from this point to the wellbore bottom is lost and must be redrilled which can cause extra days of drilling and expense in regaining the original wellbore depth.

It is, therefore, the specific feature of the present invention to provide a method for tripping in and out of the wellbore without any such side-tracking of the drill bit. This method is carried out by providing a downhole drill bit motor 13 that is free to rotate the drill bit 12 independently of the rotation of the drill pipe 18 by the top drive drill motor 32. During tripping, when the drill pipe is being rotated in one direction and drilling fluid is being circulated, the down hole drill motor rotates the drill bit in the opposite direction from that of the drill pipe and at the same speed as that of the drill pipe. In this manner, the drill bit, even though being rotated during tripping, remains rotationally stationary relative to the wellbore since its rotation is offset in the opposite direction by the rotation of the drill pipe. Even though the drill bit drags along the lower side of the wellbore during tripping, there is no side-tracking of the drill bit.

In one embodiment, the top drive drilling motor, or power swivel system, is of the type manufactured and supplied by Varco Drilling Systems, a Varco International, Inc. company, 800 N. Eckhoff Street, Orange, Calif. 92668. Such system is illustrated and described in conjunction with well drilling operations in an article entitled "New Power System Looks Promising", *Drilling Contractor*, March 1983, an official publication of the International Association of Drilling Contractors. The downhole drill motor is a positive-displacement-type that is driven by power supplied from the circulating drilling fluid, such as the Moineau pump manufactured and supplied by Dyna-Drill, Irvine, California. The rotational speed of the positive-displacement downhole motor is determined by the flow rate of the circulating drilling fluid. Thus, with a drill pipe 18 rotational speed 40 to 100 rpm during tripping, the drilling fluid circulation is adjusted by means of pump 14 to provide an opposite rotational speed of 40 to 100 rpm for the downhole motor 13 and drill bit 12. A turbine-type downhole motor could alternatively be utilized, but its speed is not controllable as is the positive-displacement-type motor.

The drill string 17 is illustrated in the FIGURE as being pulled out of the well during tripping operations such that a stand 39 of three drill pipe sections 40–42 are above the rig floor 43. At this point, the stand 39 is to be broken out of the drill string 17 at the joint 44.

Having now described the method of the present invention in connection with a preferred embodiment, it is to be understood that various modifications and changes may be made without departing from the spirit and scope of the invention as set forth in the appended claims.

I claim:

1. A method for lowering a drill string formed with a plurality of sections of drill pipe and a drill bit at the lower end thereof into a deviated wellbore in which the weight of the drill bit rests along the lowerside of the deviated wellbore above the bottom of the wellbore, comprising the steps of:

(a) rotating the drill pipe, (b) rotating said drill bit in the opposite direction from that of said drill pipe with a positive displacement downhole motor driven by the circulation of drilling fluid through the drill pipe and the annulus between the drill pipe and the wellbore, (c) lowering said drill string in the deviated borehole by dragging said drill pipe and drill bit along the lowerside of said deviated borehole, and (d) adjusting the flow rate of said circulating drilling fluid so as to rotate said drill bit at the same speed as that of said drill pipe, whereby said drill bit remains rotationally stationary with respect to said wellbore and does not side-track into the lower side of the wall of said wellbore as the drill bit drags along the lower side of the wellbore during lowering of the drill string through said wellbore toward the bottom of the wellbore.

* * * * *